United States Patent [19]

Wallis et al.

[11] Patent Number: 4,646,554

[45] Date of Patent: Mar. 3, 1987

[54] PROCESS FOR THE MANUFACTURE OF A RACK

[75] Inventors: Kurt Wallis; Roland Dangelmaier; Ansgar Betz, all of Schwäbisch Gmünd, Fed. Rep. of Germany; Heinrich Schmid, Rapperswil, Switzerland

[73] Assignee: Zahnradfabrik Friedrichshafen AG., Fed. Rep. of Germany

[21] Appl. No.: 762,796

[22] Filed: Aug. 2, 1985

Related U.S. Application Data

[63] Continuation-in-part of Ser. No. 458,976, Jan. 18, 1983, abandoned.

[30] Foreign Application Priority Data

Jan. 25, 1982 [DE] Fed. Rep. of Germany ..... 3202254

[51] Int. Cl.[4] ..... B21K 1/00; B21D 53/00; B21J 13/02

[52] U.S. Cl. ..... 72/406; 29/159.2; 74/422

[58] Field of Search ..... 72/406, 67, 115, 112, 72/125; 29/159.2; 74/422, 498; 409/48

[56] References Cited

U.S. PATENT DOCUMENTS

| | | | |
|---|---|---|---|
| 2,463,771 | 3/1949 | Hunz | 74/422 |
| 2,487,553 | 11/1949 | Hunz | 74/422 |
| 3,107,559 | 10/1963 | Beche | 72/406 |
| 3,494,161 | 2/1970 | Silichev | 72/406 |
| 3,703,823 | 11/1972 | Wilson | 72/406 |
| 3,753,378 | 8/1973 | Bishop | 74/422 |
| 4,116,085 | 9/1978 | Bishop | 74/422 |
| 4,215,591 | 8/1980 | Bishop | 74/422 |
| 4,296,641 | 10/1981 | May | 74/422 |

FOREIGN PATENT DOCUMENTS

| | | | |
|---|---|---|---|
| 1560758 | 3/1969 | France | 72/67 |
| 62734 | 5/1981 | Japan | 29/159.2 |
| 2056894 | 3/1981 | United Kingdom | 29/159.2 |
| 613843 | 7/1978 | U.S.S.R. | 72/406 |

OTHER PUBLICATIONS

VDI Report No. 266, Heinrich Schmid, "Umformen Nach Dem Taumelverfahren," 1976, pp. 29–35.

*Primary Examiner*—Daniel C. Crane
*Attorney, Agent, or Firm*—Hayes, Davis & Soloway

[57] ABSTRACT

A process for the manufacture of a rack, specially a rack having variable transmission, wherein the teeth of the rack have in the central area a profile different from that of the outer portions. The rack is formed from a blank in a press having an upper die and a lower die. The rack is manufactured by cold-mold pressing and one die portion carries out, during the pressing operations, a wobbling movement over the blank. In an apparatus for carrying out the process, a die forms the negative mold for the lower portion of the rack to be manufactured. In the other die is molded in negative mold the toothed profile of the rack to be manufactured.

4 Claims, 8 Drawing Figures

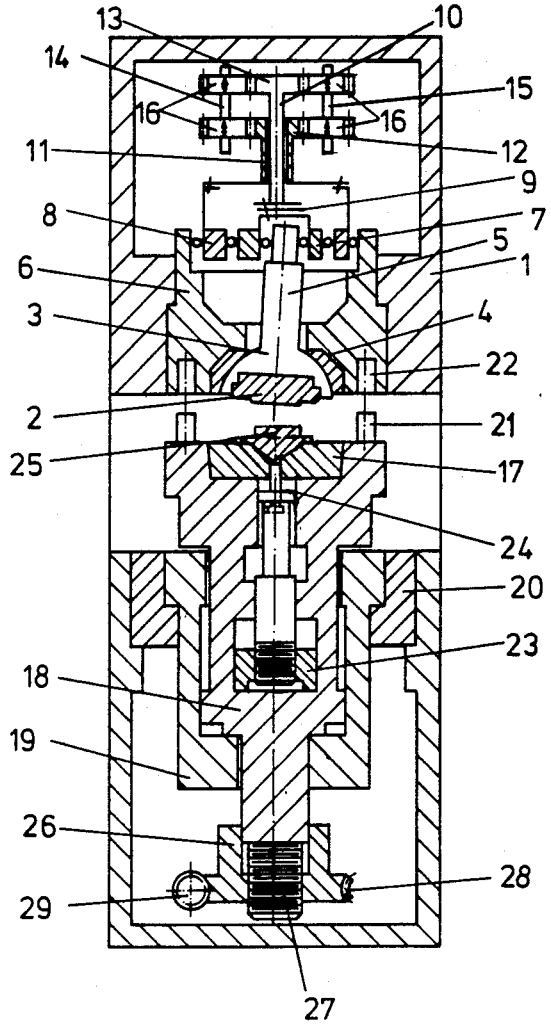
FIG. 1
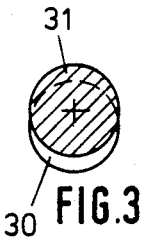
FIG.3
FIG.2
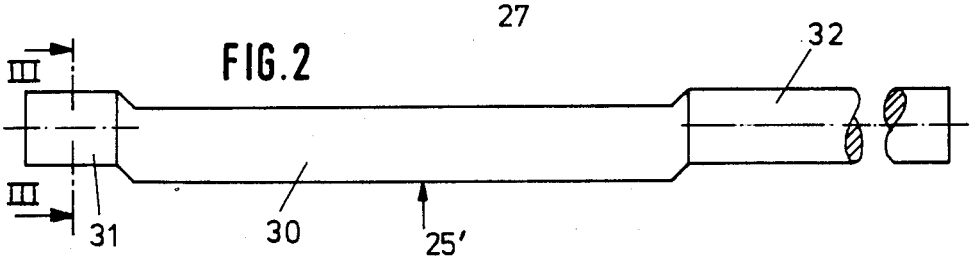
FIG.4
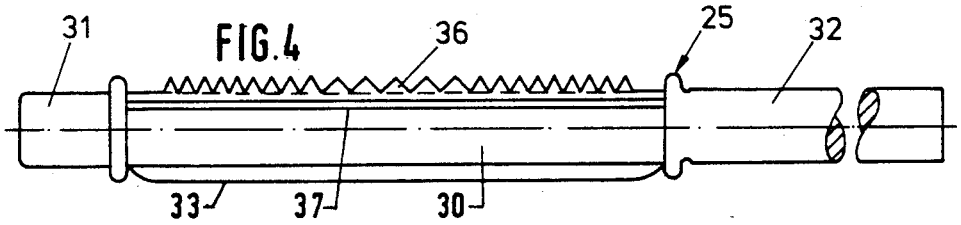

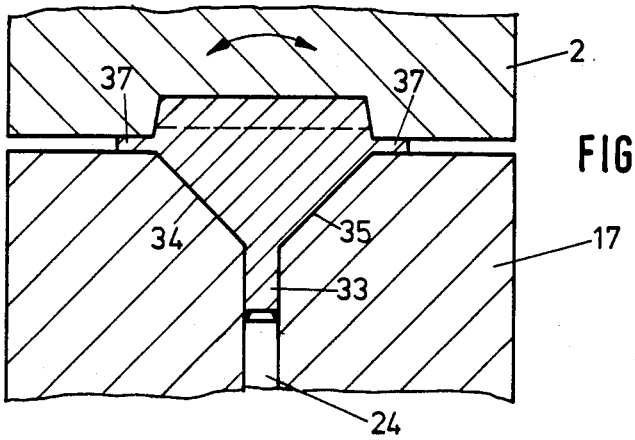
FIG.5
FIG.6
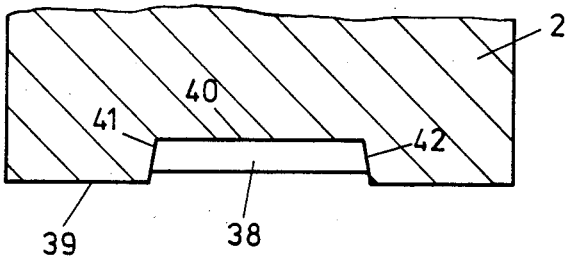
FIG.7
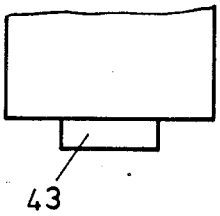
FIG.8
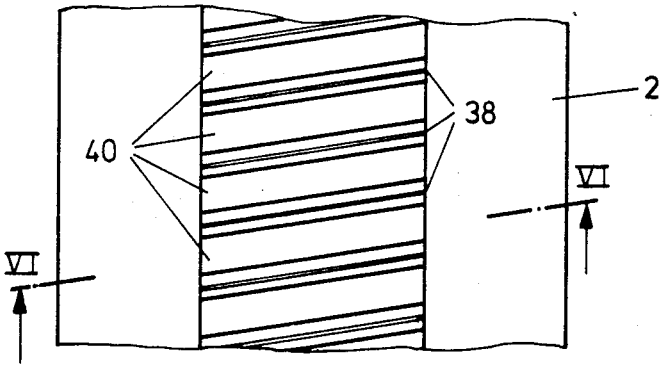

PROCESS FOR THE MANUFACTURE OF A RACK

This application is continuation-in-part of my copending application Ser. No. 458,976 filed Jan. 18, 1983, now abandoned.

The invention is concerned with a process and apparatus for the manufacture of a rack having a variable transmission wherein the teeth of the rack have a profile that differs from the central portion to the outer portion.

In German published patent application No. 21 41 205 there has been described a steering mechanism for vehicles wherein a rack for a variable transmission has teeth which, in the central area, have a profile different from that of the teeth in the outer portions. Steering mechanisms having racks of that kind can be advantageously used, for instance, in passenger vehicles (with or without servo steering) employing a ratio of about less than 2:1 which is desirable for an optimal steering behavior. For this purpose the transmission, starting from the rack center toward both sides, must change quickly until reaching a substantially constant transmission ratio. Such a rack interacts with a pinion provided with helicoidal teeth and having an axis that defines with the axis of the rack an angle diverging from 90°. In the central portion of the rack the side lines of the teeth thereof define with the pinion axis one angle and in the outer portions of the rack, the angle is changed in respect to the angle in the center portion. With this design transmission ratios of 2:1 can be achieved without difficulties.

In German published patent application No. 21 41 205 it has been suggested to produce the rack by a straight-line broaching operation for the multiplicity of the teeth so that only a small number of teeth must be manufactured in a special manner in the central area of the rack. In a separate treatment the profiles of the central teeth must then be accordingly changed by a special broaching process. But this manufacturing process of the rack is disadvantageous in that it is very wasteful and costly and cannot in this manner be economically carried out.

Therefore, the instant invention is based on the problem of providing a process for the manufacture of a rack of the kind mentioned at the beginning by which process said rack can be easily and economically produced in great quantities and with greater precision.

According to the invention, this problem is solved by producing the rack from a blank by cold-mold pressing in a press having an upper die and a lower die, one die portion effecting during the pressing operation a wobbling movement over the blank.

A cold molding or cold impact molding with a wobbling die offers various advantages in comparison with the metal cutting process. Thus, for instance, the production time is shorter, the need of material is less, and there is obtained an increased strength of the material and smooth surfaces with narrow tolerances.

Although apparatus for cold impact forming with a wobbling die are basically known already for producing different parts (see VDI report No. 266 (1976) p. 29/35), their range of use was confined only to small and easily moldable parts, since the pressing force of the press was limited on account of its construction and specially on account of the gear for producing the wobbling movement.

The racks produced according to the process of the invention are specially adequate for production in series, since they can be manufactured very quickly and cheaply. The increased strength of the material specially has a very advantageous effect in relation to the gearing forces that appear in the steering. The same applies to the high precision obtainable with this process. It has been established that an increase of strength of up to 50% can be obtained for the surface zones.

A round bar can in a simple manner be used as blank for the production of the rack. Other blank shapes are of course also possible. But a round bar is a simple and cheap raw material.

A very advantageous design of the blank consists in that it is offset in relation to one or both ends in the area to be provided with teeth.

This feature has the advantage that after the pressing process the toothing, together with the end areas of the rack, lie in a common plane of symmetry. In this manner the steering-gear housing can remain smaller, since no larger distance between axes is needed. If a rack for steering with lateral cross tie connection has to be manufactured, then the blank is offset in relation to both ends. In a steering with central drive the toothed portion of the rack extends until one end so that in this case only the other end of the blank must be offset.

The process according to the invention is specially suited to the production of a rack with changeable transmission, but, in case it is needed, a "normal" rack can obviously be also produced in this matter.

In an apparatus for carrying out the process one die forms the negative mold for the lower portion of the rack to be produced and in the other die is molded (in negative mold) the toothed profile of the rack to be produced.

Preferably the die for the toothed profile is the upper die that carries out the wobbling movement. In the preferred embodiment of the invention the wobbling movement is solely a rocking movement in which the upper die rocks around an axis which is parallel to the axis of the elongated blank from which the rack is to be formed. This rocking is on the order of only 1 to 2 degrees, (preferably 1.5 degrees) on each side of a line normal to the axis. This has several advantages making up for a simple apparatus and high uniform intensification of the metal in the formed rack. It is thus possible to take raw material which has a normal or even a low strength and, due to the intensification of the material during the preferred tilting forming operation, the material receives excellent hardness and it is not necessary to subsequently harden or temper the material. These additional steps may be necessary in previous known processes in producing racks. Another advantage is that all of the teeth of the rack can be formed exactly and one can use starting material having a relatively rough surface since the tilting compression of the barstock the resultant formed teeth will form will be provided with a very smooth surface.

In this manner the toothed profile is molded in the blank with slight consumption of energy and high precision.

In another embodiment it can be provided that the die for the lower portion of the rack to be produced be shaped in a manner such that there is formed on the underside of the rack a stem lying in the vertical plane of symmetry and extending in its longitudinal direction at least approximately over the area to be provided with teeth.

This feature brings a substantial increase of the bending strength of the rack and a good guidance in the thrust piece that presses the rack against the pinion that interacts with it. The thrust piece is here supported in the steer-gear housing and is pressed against the rack by a compression spring.

The dies are advantageously constructed in a manner such that the rack to be produced, seen in cross section, has at least approximately a Y-profile. This shape of the rack has already been disclosed in principle in German laid-open patent application No. 26 58 786. (U.S. Pat. No. 4,116,485, issued Sept. 26, 1978). By virtue of this shape the thrust piece is closer to the core of the rack.

A preferred design of the die portion for forming the toothed profile has the die teeth arranged in recesses in the press face facing the blank. With this arrangement the tooth tips of the negative die teeth portion are well bound with the press face.

Normally when parts are being pressed or punched, hollows, recesses and the like are made in the workpiece by negative molds correspondingly projecting on a die portion. However, in the instant case, according to the invention, the teeth that form the tooth spaces in the rack are molded in the die portion so as not to project above the press face.

By virtue of these features, when producing the rack from the blank, the teeth of the rack to be manufactured are pressed during the wobbling of the die into the recesses of the die portion. Since now the tooth itself lies more deeply in the upper die or is highly compact with the press face, the teeth of the rack are also prevented from flowing away laterally during the wobble pressing. Thus, a clean profile results on the sides of the rack. Unlike in a conventional pressing process, there result no ridge formation on the side and no danger of cracking. By virtue of the lateral limitations there are practically obtained a brake for the flow of material and at the same time a better compression.

Another improvement in this connection consists in that the tooth tips of the negative teeth in the die portion lie deeper in comparison to the press face. This depth can be 1 or 2 mm, as the case may be. This design has the advantage that the tooth edges in the die portion are intergrown with the whole body of the die. This means that the teeth in the die portion are each laterally further connected with the die. In this manner the teeth of the rack become also stabler, since they are thereby likewise laterally interconnected.

Another advantage of this design is to increase the service life of the "wobbling die", since it is thereby stabler.

An additional very important advantage is obtained by this arrangement of the tooth tips due to the extensions obtained thereby on both sides along the teeth. During the pressing operation a displacement of material occurs on the blank. This displacement of material is now absorbed in the form of these extensions. In addition, the extensions on this place lead to an increase of the moment of resistance of the rack.

An apparatus for carrying out the process comprises a press in which the upper die is attached by a plug in a bell-shaped socket wherein the plug enters an eccentric sleeve that in turn is enclosed in a second eccentric sleeve rotatably supported in the press housing. Both eccentric sleeves can be driven independently of each other by driving shafts having drive gears and can be interconnected by a back gear with several connectable gears. The drive gears are preferably spur wheels and the back-gear has disposed, parallel with the drive shafts, two or more intermediate shafts with gears that can be coupled at will with the drive gears. The drive gears are so arranged that the stem of the upper die oscillates or rocks, in a plane which is normal to the plane of the axis of the elongated work piece which is to be formed. As mentioned this rocking is preferably about 1.5° on each side of a line normal to the axis.

In the prior art, it had hitherto been possible to obtain different kinds of movement of the upper die. Previously, to this end the two drive gears for the two shafts of the eccentric sleeves were worm wheels, one worm wheel being connected to a motor drive shaft directly or by an intermediate gear. From this worm wheel, a worm interacting therewith delivered the driving power on a back gear where were situated several gears connected at will. On the output shaft of the prior art back gear there was a second worm that meshed with the other worm wheel of the second shaft for the second eccentric sleeve. It was thus possible to carry out different wobbling movements of the upper die on the workpiece to be processed.

However, the disadvantage of this prior design was that it was possible to apply to the lower die only maximum pressing forces of about 2500 kN. But specially on account of the worm gear it was no longer possible to apply any stronger forces. Still stronger pressing forces would have actually required even larger worm wheels and worms. But this would have resulted on the one hand in an excessively high cost and on the other in that the degree of effectiveness obtainable therewith would also have become very poor.

With the assembly according to the invention of spur wheels and back gear parallel therewith, it is possible, however, to transmit substantially stronger forces. Also by an adequate arrangement and connection of gears on the intermediate shafts it is possible in this design to carry out the most different wobbling movements.

Herebelow is illustrated in principle an embodiment of the invention with reference to the drawing.

In the drawing.

FIG. 1 is a longitudinal section through a wobbling press in a basic illustration, FIG. 2 is a side view of a blank, FIG. 3 is section III—III according to FIG. 2, FIG. 4 is a finished rack in side view, FIG. 5 is a cutout enlargement of the two die portions in cross section, FIG. 6 is an upper die in section according to line VI—VI of FIG. 8, FIG. 7 is a basic illustration of an upper die according to the prior art, FIG. 8 is a view of the upper die of the invention from the bottom.

The wobbling press comprises a frame 1 that can be built of one or several parts. In the upper area of the frame 1 is attached an upper die 2 in a bell-shaped socket 3. The bell-shaped socket 3 is pivotally supported in a bearing 4 of the bell-shaped socked, and said bell-shaped socket 4 is itself attached in an insert part 6 in the frame 1. To the bell-shaped socket 3 is secured a plug 5 that is supported in an eccentric sleeve 7. Said eccentric sleeve 7 is in turn enclosed in a second eccentric sleeve 8 rotatably mounted in the frame 1.

Both eccentric sleeves 7 and 8 can be driven independently of each other. To the end, the inner eccentric sleeve 7 is connected to a shaft 10 via a driving disc 9. The rotating motion of the shaft 10 is transmitted to the eccentric motion of the eccentric sleeve 7 via the driving disc 9. The outer eccentric sleeve 8 is in turn connected with a hollow shaft 11 in the interior of which the shaft 9 is rotatably supported in respect to the hollow shaft 11. On the hollow shaft 11 is secured a drive gear 12 that is a straight or helically toothed spur wheel. The drive gear 12 is connected either directly or indirectly with a driving motor (not shown) via an intermediate gear.

The shaft 10 is likewise connected with a drive gear 13. Two or more intermediate shafts 14 and 15 situated parallel with the drive shafts 10 and 11 have several gears 16. The drive gears 16 can be coupled in any manner desired according to necessity with the drive gear 12 and thus also transmit the driving torque with corresponding increased or reduced speed to the drive gear 13.

In this manner can be obtained as desired the same or different speeds and rotating directions of both shafts 10 and 11, whereby it is possible to produce the most different wobbling movements.

Thus, for instance, circular movements, spiral movements, multi-lobe curve movements, straight movement, and the like are possible. The angle of inclination can also be freely selected.

A lower die 17 is secured in a ram 18. The ram 18 is guided in a main cylinder 19 connected with the frame 1 via an intermediate ring 20. The ram 18 is provided with guide columns 21 that can be inserted in corresponding bores 22 in the insert part 6 during the pressing operation.

After terminating the pressing operation, an ejecting piston 23 with an ejector 24 serves for ejecting the finished rack 25.

The ejecter 24 rests in a threaded bore of the ejecting piston 23 and can be in this manner be adjusted in its height.

The ram 18 is likewise provided at its lower end with a stop nut 26 for the upper stroke limitation. The stop nut 26 interacts with a threaded part 27 of the ram 18 and is provided in its periphery with a worm gear 28 that interacts with a worm 29. In this manner the stroke limitation can be adjusted by motor.

The pressing power is hydraulically built up in the lower portion of the apparatus. For this purpose the piston spaces between the ram 18 and the main cylinder 19 are adequately provided with hydraulic fluid. The ejecting piston 23 is likewise hydraulically actuated.

In the manufacture of the rack 25 from a blank shaped as a round bar 25' (see FIGS. 2 and 3) the latter is molded between the upper die 2 and the lower die 17, the upper die 2 carrying out a wobbling movement. The molding force thus concentrates only on a part of the workpiece surface. The pressure zone moves over the whole workpiece surface and thereby effects the shaping.

As it can be seen from FIGS. 2 and 3, the blank is a round bar 25', the part 30 that is to be provided with teeth being offset in respect to both ends 31 and 32. As it can be seen from FIG. 4, a finished rack 25 results whereby after shaping of the blank, both ends 32 and 31 lie together with the rack part 30 in a symmetry plane. As can further be seen from FIG. 4, and specially also from the cross section in FIG. 5, the finished rack—seen in cross section—has a substantially Y-profile. Here the rack 25 is provided on its underside with a stem 33 that extends in longitudinal direction in the vertical symmetry plane running approximately over the area 30 to be provided with teeth. Starting from the stem 33, two inclined planes 34 and 35 lead to the rack side. Both inclined planes 34 and 35 constitute the bearing areas for the thrust piece after the assembly in a steering gear. Both end portions 31 and 32 remain round, but when needed can receive any other shape.

On each of the two longitudinal sides adjacent the teeth 36 of the rack 25, there is disposed an extension 37 that runs parallel with the longitudinal axis of the rack 25. Both extensions 37 lie somewhat deeper than the tooth base, and thus the complete tooth shape is retained. The formation of the two extensions 37 becomes clear with reference to the explanations regarding FIGS. 5 to 8.

FIG. 5 shows an enlarged cross section through the upper die 2 and the lower die 17 with a finished rack 25 in cross section. Both extensions 37 adjacent the teeth are here formed by the displacement of material during the pressing operation.

As it can in particular be seen from FIGS. 6 and 8, the teeth 38 in the upper die 2 which shape the tooth spaces in the rack 25 are offset back in respect to the press plane 39, that is, the tooth tips lie somewhat deeper. In this manner the teeth 38 are firmly intergrown with the die body in the upper die 2 and thus withstand high loads. Besides, during the pressing operation, material from the blank 25' is pressed into the recesses 40 in the upper die 2 for the formation of the teeth 36 of the rack. But as it can be specially seen from FIG. 6, an undefined lateral flow of material through the sidewalls 41 and 42 of the recesses is prevented. No seam formation results and the teeth have on their sides a clean profile without need of any refinishing operation.

Unlike that, there is shown in FIG. 7 a die of conventional prior art construction where corresponding attachments 43 were used in an upper die for producing recesses in a workpiece.

We claim:

1. A process for the manufacture of a rack, specially a rack having variable transmission, wherein the teeth of the rack have in the central area a profile different from that of the outer portion, said process comprising the steps of:

(a) providing elongate round bar having a longitudinal axis, (b) providing a first die having a recessed negative of the teeth to be formed in the rack, said negative recess having a toothed central and outer area with the central area teeth having a different profile from the outer area teeth, said first die being recessed with respect to the press plane and shaped to form the lateral edges of the teeth as well as the faces thereof, (c) providing a second die having a negative of the remainder of the rack, (d) rocking said first die with respect to said second die while applying sufficient pressure to cold deform the round bar, (e) said rocking step being carried out only in a direction substantially normal to the axis of the bar with essentially no movement along the bar axis, (f) said recess negative of the first die preventing material of the teeth from flowing away laterally during the rocking step, to provide teeth with finished lateral edges and faces.

2. A process according to claim 1, wherein there is used a blank that is offset in the area to be provided with teeth in respect to at least one end of said blank.

3. The process of claim 1 wherein the rocking motion is limited to 1 to 2 degrees on each side of a line normal to the axis.

4. The process of claim 1 wherein the rocking is limited to about 1.5 degrees on each side of a line normal to the axis.

* * * * *